US009196415B2

(12) United States Patent
Takagi et al.

(10) Patent No.: US 9,196,415 B2
(45) Date of Patent: Nov. 24, 2015

(54) COIL COMPONENT

(71) Applicant: TDK Corporation, Tokyo (JP)

(72) Inventors: Nobuo Takagi, Tokyo (JP); Setu Tsuchida, Yamagata (JP); Tasuku Mikogami, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/675,914

(22) Filed: Apr. 1, 2015

(65) Prior Publication Data

US 2015/0287520 A1 Oct. 8, 2015

(30) Foreign Application Priority Data

Apr. 3, 2014 (JP) ..... 2014-076816
Jul. 30, 2014 (JP) ..... 2014-154977

(51) Int. Cl.

| | |
|---|---|
| ***H01F 27/00*** | (2006.01) |
| ***H01F 27/29*** | (2006.01) |
| ***H01F 27/28*** | (2006.01) |
| ***H01F 5/00*** | (2006.01) |
| ***H01F 27/02*** | (2006.01) |

(52) U.S. Cl.
CPC ..... *H01F 27/29* (2013.01); *H01F 5/00* (2013.01); *H01F 27/00* (2013.01); *H01F 27/02* (2013.01); *H01F 27/2823* (2013.01)

(58) Field of Classification Search
CPC ..... H01F 5/00; H01F 27/00–27/30
USPC ..... 336/65, 83, 192, 200, 232
See application file for complete search history.

(56) References Cited

U.S. PATENT DOCUMENTS

| | | | | |
|---|---|---|---|---|
| 8,686,822 | B2 * | 4/2014 | Huang et al. | 336/192 |
| 8,937,522 | B2 * | 1/2015 | Lai et al. | 336/192 |
| 2010/0109827 | A1 | 5/2010 | Asou et al. | |

FOREIGN PATENT DOCUMENTS

| | | |
|---|---|---|
| JP | 2010-109267 | 5/2010 |

* cited by examiner

*Primary Examiner* — Tuyen Nguyen
(74) *Attorney, Agent, or Firm* — Young Law Firm, P.C.

(57) ABSTRACT

Disclosed herein is a coil component that includes first and second terminal electrodes provided on the core. The first wire includes a first lead section extending from a winding core portion toward the first terminal electrode so as to cross the winding core portion, and a first connecting section connected to the first terminal electrode. The second wire includes a second lead section extending from the winding core portion toward the second terminal electrode so as to cross the winding core portion, and a second connecting section connected to the second terminal electrode. The first lead section crosses the second lead section so as to pass under the second lead section. The second connecting section is located closer to a far side in an extending direction of the winding core portion than the first connecting section.

20 Claims, 8 Drawing Sheets

COIL COMPONENT

BACKGROUND OF THE INVENTION

1. Field of the Invention The present invention relates to a coil component, and particularly to a wire-connection structure of a surface-mount pulse transformer.

2. Description of Related Art

A pulse transformer is known as one of coil components. For example, the pulse transformer is provided in a connector that constitutes a connection point between a device, such as personal computer, and a LAN cable. The pulse transformer sends a pulse signal via the LAN cable. The pulse transformer serves to block ESD (Electro Static Discharge) or high voltage from entering and protect an internal circuit by an insulation between primary and secondary windings.

For example, Japanese Patent Application Laid-open No. 2010-109267 discloses a small surface-mount pulse transformer capable of high-density mounting. The pulse transformer includes a drum core, which has a winding core portion and a pair of flanges; and primary and secondary windings, Which are wound around the winding core portion of the drum core and each are equipped with a center tap. A first and a second terminal electrode, which connect both ends of the primary winding via a wire, and a third terminal electrode, which connects the center tap of the secondary winding with a wire, are provided in one of the flanges of the drum core. A fourth terminal electrode, which connects the center tap of the primary winding via a wire, and a fifth and a sixth terminal electrode, which connect both ends of the secondary winding with a wire, are provided in the other flange of the drum core. In this pulse transformer, two terminal electrodes that are connected with wires at the same timing are disposed in the same flange. Therefore, it is possible to reduce a winding work time at a time when an automatic winding machine that can perform wire-connection work only on one flange at one time is used to perform winding work.

In the conventional pulse transformer described above, the two ends of the primary winding wound around the winding core portion and the two ends of the secondary winding wound around the winding core portion are pulled out from the winding core portion and are connected via wires to corresponding terminal electrodes. In particular, the conventional pulse transformer has a wire-connection structure in which two lead wires that are pulled out from the winding core portion in a diagonally downward direction toward corresponding terminal electrodes cross each other. Accordingly, there is a possibility that the upper lead wire is pushed upward after coming in contact with the lower lead wire. A base portion of a wire-connection portion of the upper lead wire that is bonded in a thermo-compression manner to the terminal electrode may be subjected to an extra load due to the stress generated at that time.

Therefore, the object of the present invention is to provide a highly reliable coil component that can prevent an extra load being applied to a base portion of a wire-connection section in a wire-connection structure in which two wires that are wound around a winding core portion cross each other before being connected to corresponding terminal electrodes.

SUMMARY

To solve the above problems, a coil component in a first aspect of the present invention includes a core that includes a winding core portion; first and second wires that are wound around the winding core portion; and first and second terminal electrodes that are provide on a surface of the core, wherein the first wire includes a first lead section that extends in a diagonally downward direction from the winding core portion toward the first terminal electrode so as to cross the winding core portion, and a first connecting section that is connected to the first terminal electrode, the second wire includes a second lead section that extends in a diagonally downward direction from the winding core portion toward the second terminal electrode so as to cross the winding core portion, and a second connecting section that is connected to the second terminal electrode, the first lead section crosses the second lead section so as to pass under the second lead section, and a base position of the second connecting section when viewed from the winding core portion side is located closer to a far side in an extending direction of the winding core portion than a base position of the first connecting section.

According to the present invention, the base position of the connecting section of the second wire connected to the second terminal electrode is located farther from the winding core portion than the base position of the connecting section of the first wire connected to the first terminal electrode when viewed from the winding core portion side. Therefore, contact pressure that the first wire receives from the second wire at a cross point of the first and second wires can be suppressed. Accordingly, it is possible to prevent an extra load being applied to the base position of the connecting section of the first wire. Thus, it is possible to provide a highly reliable coil component.

In the present invention, a length of the second terminal electrode in the extending direction of the winding core portion is preferably less than a length of the first terminal electrode in the extending direction of the winding core portion, and a near-end-side edge of the second terminal electrode when viewed front the winding core portion side is preferably located closer to a far side in the extending direction of the winding core portion than a near-end-side edge of the first terminal electrode. According to this configuration, the second connecting section on the second terminal electrode can be easily positioned closer to the far side in the extending direction of the winding core portion than the first connecting section, and a terminal portion of the second wire can be easily connected onto the second terminal electrode.

In the present invention, the first terminal electrode and the second terminal electrode are preferably line-symmetric, when viewed from a central axis of the winding core portion. If the first terminal electrode is located on the opposite side of the central axis from the second terminal electrode, the distance between the two terminal electrodes is long. As a result, the lead sections of the wires become longer, resulting in an increase in the contact pressure between the wires at the cross point. The present invention can solve such a problem, and can provide a highly reliable coil component.

In the present invention, the core includes preferably a flange that is provided in one end of the winding core portion, and the first and second terminal electrodes are preferably provided on a surface of the flange. If the first and second terminal electrodes are provided in the flange, the first and second lead sections are extended from the winding core portion toward the flange, resulting in a rise in tension and an increase in the contact pressure at the cross point of the two. As a result, an extra load is likely to be applied to the base positions of the connecting sections, However, the present invention can solve such a problem, and can provide a highly reliable coil component.

In present invention, the first and second connecting sections are preferably connected by thermo-compression bonding. The above problems are likely to arise when terminal portions of the first and second wires are connected by thermo-compression bonding. However, the present invention can solve such a problem, and can provide a highly reliable coil component.

In a second aspect of the present invention, a coil component includes: a drum core including a winding core portion and first and second flanges provided at both ends of the winding core portion; first to fourth wires wound around the winding core portion; first to third terminal electrodes provided on a surface of the first flange; and fourth to sixth terminal electrodes provided on a surface of the second flange, wherein the first wire includes a first lead section extending downward from the winding core portion toward the first terminal electrode so as not to cross the winding core portion, a first connecting section connected to the first terminal electrode, a second lead section extending in a diagonally downward direction from the winding core portion toward the fourth terminal electrode so as to cross the winding core portion, and a second connecting section connected to the fourth terminal electrode, the second wire includes a third lead section extending downward from the winding core portion toward the fourth terminal electrode so as not to cross the winding core portion, a third connecting section connected to the fourth terminal electrode, a fourth lead section extending in a diagonally downward direction from the winding core portion toward the second terminal electrode so as to cross the winding core portion, and a fourth connecting section connected to the second terminal electrode, the third wire includes a fifth lead section extending in a diagonally downward direction from the winding core portion toward the fifth terminal electrode so as to cross the winding core portion, a fifth connecting section connected to the fifth terminal electrode, a sixth lead section extending downward from the winding core portion toward the third terminal electrode so as not to cross the winding core portion, and a sixth connecting section connected to the third terminal electrode, the fourth wire includes a seventh lead section extending in a diagonally downward direction from the winding core portion toward the third terminal electrode so as to cross the winding core portion, a seventh connecting section connected to the third terminal electrode, an eighth lead section extending downward from the winding core portion toward the sixth terminal electrode so as not to cross the winding core portion, and an eighth connecting section connected to the sixth terminal electrode, the fourth lead section passes under the seventh lead section to cross the seventh lead section, the fifth lead section passes under the second lead section to cross the second lead section, a base position of the seventh connecting section when viewed from the winding core portion side is located closer to an outer side surface of the first flange than a base position of the fourth connecting section, and a base position of the second connecting section when viewed from the winding core portion side is located closer to an outer side surface of the second flange than a base position of the fifth connecting section.

According to the present invention, the base position of the connecting section of the fourth wire connected to the third terminal electrode at the first flange side is located closer to the outer side surface of the first flange than the base position of the connecting section of the second wire connected to the second terminal electrode. Therefore, at a cross point of the fourth and second wires, the contact pressure that the second wire receives from the fourth wire can be curbed. Therefore, it is possible to prevent an extra load being applied to the base position of the connecting section of the second wire. Moreover, the base position of the connecting section of the first wire connected to the fourth terminal electrode at the second flange side is located closer to the outer side surface of the second flange when viewed from the winding core portion side than the base position of the wire connection of the third wire connected to the fifth terminal electrode. Therefore, at a cross point of the first and third wires, the contact pressure that the third wire receives from the first wire can be curbed. Therefore, it is possible to prevent an extra load being applied to the base position of the connecting section of the third wire. As a result, a highly reliable coil component can be provided.

In the present invention, the second and third wires are wound around the winding core portion in a bifilar manner in order to form a first winding layer; the first and fourth wires are wound over the first winding layer in a bifilar manner in order to form a second winding layer; and the winding direction of the first and fourth wires is preferably opposite to the winding direction of the second and third wires.

In the present invention, a length of the third terminal electrode in an extending direction of the winding core portion is less than a length of the first terminal electrode in the extending direction of the winding core portion; length of the fourth terminal electrode in the extending direction of the winding core portion is less than length of the sixth terminal electrode in the extending direction of the winding core portion; a near-end-side edge of the third terminal electrode when viewed from the winding core portion side is located closer to the outer side surface of the first flange than a near-end-side edge of the first terminal electrode; and a near-end-side edge of the fourth terminal electrode when viewed from the winding core portion side is preferably located closer to an outer side surface of the second flange than a near-end-side edge of the sixth terminal electrode. According to this configuration, the fifth connecting section on the third terminal electrode can be easily positioned closer to the outer side surface of the first flange than the first connecting section, and a terminal portion of the third wire can be easily connected onto the third terminal electrode. Similarly, the fourth connecting section on the fourth terminal electrode can be easily positioned closer to the outer side surface of the second flange than the eighth connecting section, and a terminal portion of the second wire can be easily connected onto the fourth terminal electrode.

In the present invention, the first and fourth terminal electrodes and the third and sixth terminal electrodes are preferably line-symmetric, respectively, when viewed from a central axis of the winding core portion. If the first terminal electrode is located on the opposite side of the central axis from the third terminal electrode, and if the fourth terminal electrode is located on the opposite side of the central axis from the sixth terminal electrode, the distance between the two terminal electrodes located at symmetric positions is long. As a result, the lead sections of the wires become longer, resulting in an increase in the contact pressure between the wires at the cross point. The present invention can solve such a problem, and can provide a highly reliable coil component.

In the present invention, a width of a space between the second and third terminal electrodes is preferably greater than a width of a space between the first and second terminal electrodes; and a width of a space between the fourth and fifth terminal electrodes is preferably greater than a width of a space between the fifth and sixth terminal electrodes. According to this configuration, it is possible to ensure dielectric strength between a primary winding terminal and a secondary winding terminal which are provided on a common flange.

In the present invention, the first to eighth connecting sections are preferably connected by thermo-compression bonding. The above problems are likely to arise when terminal portions of the first to fourth wires are connected by thermo-compression bonding. However, the present invention can solve such a problem and provide a highly reliable coil component.

In a third aspect of the present invention, a coil component includes: a drum core including a winding core portion and first and second flanges provided at both ends of the winding core portion; first to fourth wires wound around the winding core portion; first to fourth terminal electrodes provided on a surface of the first flange; and fifth to eighth terminal electrodes provided on a surface of the second flange, wherein the first wire includes a first lead section extending downward from the winding core portion toward the first terminal electrode so as not to cross the winding core portion, a first connecting section connected to the first terminal electrode, a second lead section extending in a diagonally downward direction from the winding core portion toward the sixth terminal electrode so as to cross the winding core portion, and a second connecting section connected to the sixth terminal electrode, the second wire includes a third lead section extending downward from the winding core portion toward the fifth terminal electrode so as not to cross the winding core portion, a third connecting section connected to the fifth terminal electrode, a fourth lead section extending in a diagonally downward direction from the winding core portion toward the second terminal electrode so as to cross the winding core portion, and a fourth connecting section connected to the second terminal electrode, the third wire includes a fifth lead section extending in a diagonally downward direction from the winding core portion toward the seventh terminal electrode so as to cross the winding core portion, a fifth connecting section connected to the seventh terminal electrode, a sixth lead section extending downward from the winding core portion toward the fourth terminal electrode so as not to cross the winding core portion, and a sixth connecting section connected to the fourth terminal electrode, the fourth wire includes a seventh lead section extending in a diagonally downward direction from the winding core portion toward the third terminal electrode so as to cross the winding core portion, a seventh connecting section connected to the third terminal electrode, an eighth lead section extending downward from the winding core portion toward the eighth terminal electrode so as not to cross the winding core portion, and an eighth connecting section that is connected to the eighth terminal electrode, the fourth lead section passes under the seventh lead section to cross the seventh lead section, the fifth lead section passes under the second lead section to cross the second lead section, a base position of the seventh connecting section when viewed from the winding core portion side is located closer to an outer side surface of the first flange than a base position of the fourth connecting section, and a base position of the second connecting section when viewed from the winding core portion side is located closer to an outer side surface of the second flange than a base position of the fifth connecting section.

According to the present invention, the base position of the connecting section of the fourth wire connected to the third terminal electrode at the first flange side is located closer to the outer side surface of the first flange than the base position of the connecting section of the second wire connected to the second terminal electrode. Therefore, at a cross point of the fourth and second wires, the contact pressure that the second wire receives from the fourth wire can be curbed. Therefore, it is possible to prevent an extra load being applied to the base position of the connecting section of the second wire. Moreover, when viewed from the winding core portion side, the base position of the connecting section of the first wire connected to the sixth terminal electrode at the second flange side is located closer to the outer side surface of the second flange than the base position of the wire connection of the third wire connected to the seventh terminal electrode. Therefore, at a cross point of the first and third wires, the contact pressure that the third wire receives from the first wire can be curbed. Therefore, it is possible to prevent an extra load being applied to the base position of the connecting section of the third wire. As a result, a highly reliable coil component can be provided.

In the present invention, the second and third wires are wound around the winding core portion in a bifilar manner in order to form a first winding layer; the first and fourth wires are wound over the first winding layer in a bifilar manner in order to form a second winding layer; and the binding direction of the first and fourth wires is preferably opposite to the winding direction of the second and third wires.

A length of the third terminal electrode in an extending direction of the winding core portion is preferably less than a length of the first terminal electrode in the extending direction of the winding core portion; a length of the sixth terminal electrode in the extending direction of the winding core portion is preferably less than a length or the eighth terminal electrode in the extending direction of the winding core portion; a near-end-side edge of the third terminal electrode when viewed from the winding core portion side is preferably located closer to an outer side surface of the first flange than a near-end-side edge of the first terminal electrode; and a near-end-side edge of the sixth terminal electrode when viewed from the winding core portion side is preferably located closer to an outer side surface of the second flange than a near-end-side edge of the eighth terminal electrode. According to this configuration, the fifth connecting section on the third terminal electrode can be easily positioned closer to the outer side surface of the first flange than the first connecting section, and a terminal portion of the third wire can be easily connected onto the third terminal electrode. Similarly, the fourth connecting section on the sixth terminal electrode can be easily positioned closer to the outer side surface of the second flange than the eighth connecting section, and a terminal portion of the second wire can be easily connected onto the sixth terminal electrode.

In the present invention, when viewed from a central axis of the winding core portion, the first, second, fifth, and sixth terminal electrodes and the fourth, third, eighth, and seventh terminal electrodes are preferably line-symmetric, respectively. If the first and second terminal electrodes are located on the opposite side of the central axis from the fourth and third terminal electrodes, respectively, and if the fifth and sixth terminal electrodes are located on the opposite side of the central axis from the eighth and seventh terminal electrodes, respectively, the distance between the two terminal electrodes located at symmetric positions is long. As a result, the lead sections of the wires become longer, resulting in an increase in the contact pressure between the wires at the cross point. The present invention can solve such a problem, and can provide a highly reliable coil component.

In the present invention, a width of a space between the second and third terminal electrodes is preferably greater than a width of a space between the first and second terminal electrodes; and a width of a space between the sixth and seventh terminal electrodes is preferably greater than a width of a space between the seventh and eighth terminal electrodes. According to this configuration, it is possible to ensure dielectric strength between a primary winding terminal and a secondary winding terminal which are provided on a common flange.

In the present invention, the first to eighth connecting sections are preferably connected by thermo-compression bonding. The above problems are likely to arise when terminal portions of the first to fourth wires are connected by thermo-compression bonding. However, the present invention can solve such a problem and provide a highly reliable coil component.

According to the present invention, it is possible to provide a coil component that can prevent an extra load being applied to a base portion of a wire-connection section in a wire-connection structure in which two wires that are wound around a winding core portion cross each other on the way to be connected to corresponding terminal electrodes.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
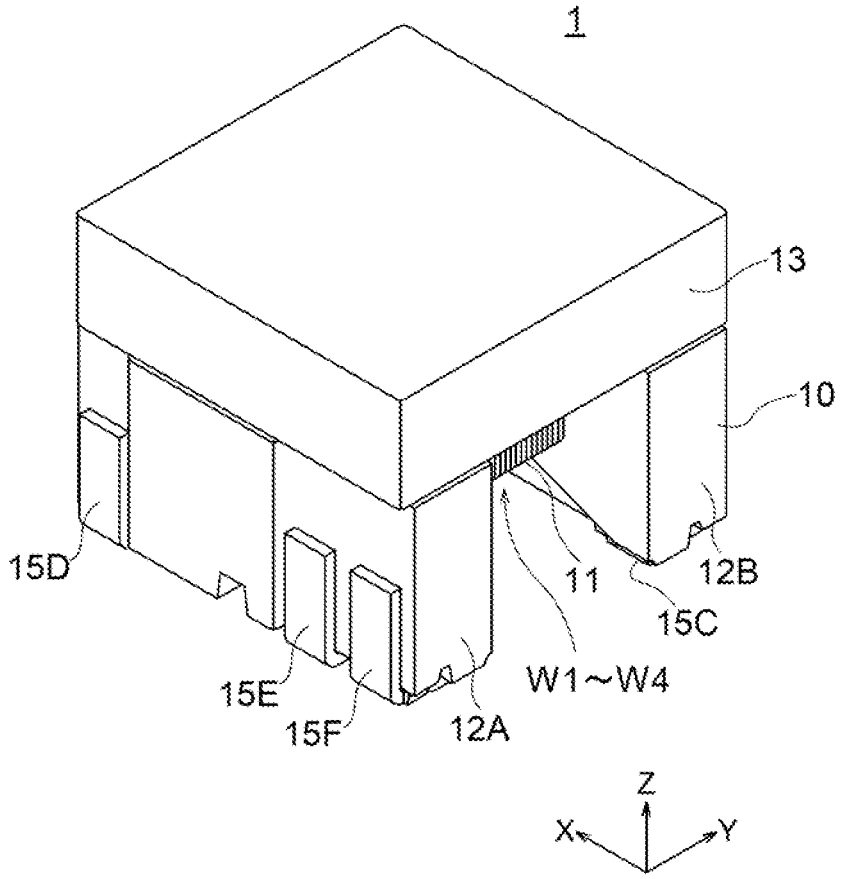
FIG. 1 is a schematic perspective view showing the external configuration of a coil component according to a first embodiment of the present invention.
Figure 2:
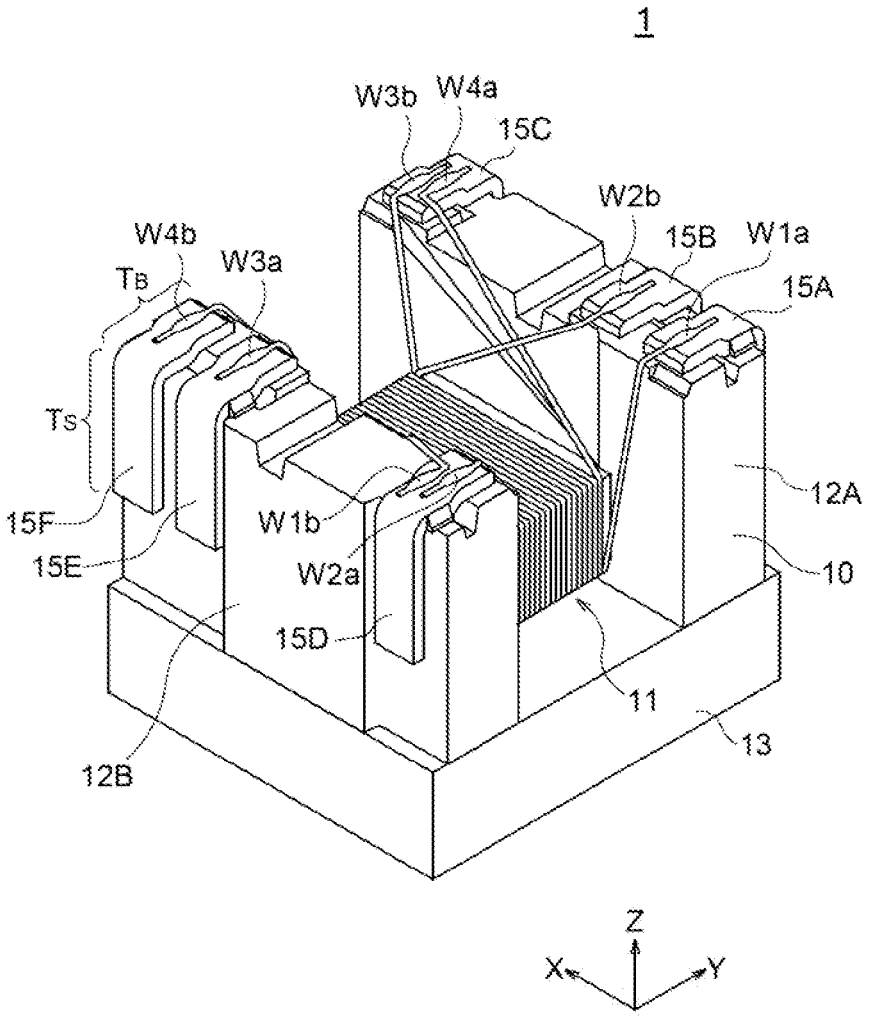
FIG. 2 is a schematic perspective view showing a state where the coil component of FIG. 1 has been turned upside down.

FIG. 1 is a schematic perspective view showing the external configuration of a coil component according to a first embodiment of the present invention. FIG. 2 is a schematic perspective view showing a state where the coil component of FIG. 1 has been turned upside down.

As shown in FIGS. 1 and 2, a coil component 1 is a pulse transformer. The coil component 1 includes a drum core 10, a plate-like core 13, six terminal electrodes 15A to 15F, and four wires W1 to W4, which are wound around the drum core 10. Although not specifically limited, the coil component 1 is a surface-mount pulse transformer, and the size thereof is about 3.3×3.3×2.7 mm.

For example, the drum core 10 is made of magnetic material such as Ni-Zn ferrite, The drum core 10 includes a winding core portion 11, around which the wires W1 to W4 are wound, and a pair of flanges 12A and 12B, which are disposed at both ends of the winding core portion 11. The plate-like core 13, too, is made of magnetic material such as Ni-Zn ferrite. The plate-like core 13 is placed on upper surfaces of the flanges 12A and 12B and is fixed with an adhesive or the like.

An upper surface of the plate-like core 13 is a flat smooth surface. Therefore, when the coil component 1 is being mounted, the smooth surface serves as a suction surface, and can be mounted in a sucking manner. It is preferred that a surface of the plate-like core 13 that is to be bonded to the upper surfaces of the flanges 12A and 12B be a smooth surface, too. It is possible to ensure that the smooth surface of the plate-like core 13 and the flanges 12A and 12B are in close contact with each other as the smooth surface of the plate-like core 13 is placed on the flanges 12A and 12B. Therefore, it is possible to form a closed magnetic circuit with no leak of magnetic flux.

Each of the terminal electrodes 15A to 15F is an L-shaped metal terminal which extends along an outer side surface of the flange 12A or 12B from a bottom surface of the flange 12A or 12B. The outer side surface of the flange is the opposite side surface from a surface where the winding core portion 11 is mounted. The terminal electrodes 15A to 15F each are preferably a metal piece that is cut out from a lead frame that is obtained by processing one metal plate. The terminal electrodes 15A to 15F are a state of the lead frame when being bonded and fixed to the drum core 10. The terminal electrodes 15A to 15F become independent terminals after being separated from the frame portion. If the terminal electrodes 15A to 15F are used, the formation of the terminal electrodes 15A to 15F is easier than that of plated electrodes. The terminal electrodes 15A to 15F are also better in terms of mass-production costs. Furthermore, it is possible to improve the positional accuracy when the terminal electrodes 15A to 15F are mounted.

As shown in FIG. 2, each of the L-shaped terminal electrodes 15A to 15F includes a bottom surface section $T_B$, which touches the bottom surfaces of the flange 12A or 12B; and a side surface portion $T_S$, which touches the outer side surface of the flange 12A or 12B. A terminal portion of each of the wires W1 to W4 is connected by thermo-compression bonding to a surface of the bettors surface section $T_B$ of a corresponding one of the terminal electrodes 15A to 15F.

Among the terminal electrodes 15A to 15F, three terminal electrodes 15A, 15B and 15C are provided on the flange 12A side. The three other terminal electrodes 15D, 15E, and 15F are provided on the flange 12B side. The terminal electrodes 15A to 15C are arranged in this order from one end side of an x-direction (or direction perpendicular to the direction (y-direction) of a central axis of the winding core portion 11 within a mounting face) shown in FIG. 2. Similarly, the terminal electrodes 15D to 15F are arranged in this order from one end side of the x-direction.

Among the three terminal electrodes 15A, 15B, and 15C, the two terminal electrodes 15A and 15B are placed closer to one end (the right side) of the flange 12A in the X-direction. The terminal electrode 15C is placed closer to the other end (the left side) of the flange 12A in the X-direction. The space of a certain width is provided between the terminal electrodes 15B and 15C, and is wider than the space between the terminal electrodes 15A and 15B. Similarly, among the three terminal electrodes 15D, 15E, and 15F, the terminal electrode 15D is placed closer to one end (the right side) of the flange 12B in the X-direction. The two terminal electrodes 15E and 15F are placed closer to the other end (the left side) of the flange 12B in the X-direction. The space of a certain width is provided between the terminal electrodes 15D and 15E, and is wider than the space between the terminal electrodes 15E and 15F. These spaces of the certain width ensure the withstand voltage between the primary and secondary windings.

According to the present embodiment, the shape of the core, the shape and arrangement of the terminal electrodes, and the overall shape of the coil component 1, including the wire-connection structure, are rotationally symmetric (dyad symmetric) when viewed from the planar-direction center of the drum core 10. If the coil component 1 is rotated 180 degrees within a plane, the positions of the terminal electrodes 15A, 15B, and 15C after rotation overlap the positions of the terminal electrodes 15F, 15E, and 15D before rotation. Furthermore, the terminal electrodes 15A and 15C are line-symmetric when viewed from the central axis of the winding core portion 11. Moreover, the terminal electrodes 15D and 15F are line-symmetric when viewed from the central axis of the winding core portion 11.

Figure 3A:
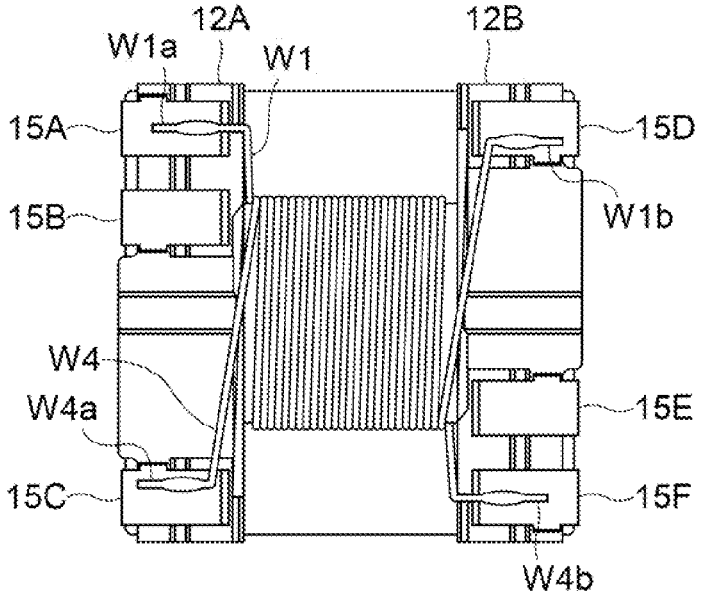
FIGS. 3A and 3B are schematic plan views for explaining how wires W1 to W4 and terminal electrodes 15A to 15F are connected.
Figure 3B:
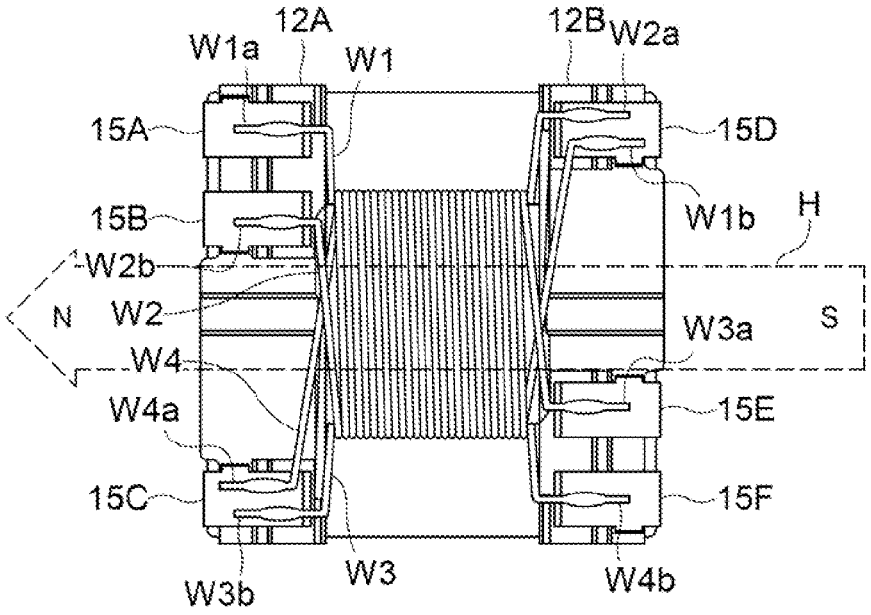

FIGS. 3A and 3B are schematic plan views for explaining how the wires W1 and W4 and the terminal electrodes 15A to 15F are connected.

As shown in FIGS. 3A and 3B, the wires W1 to W4 are coated conductive wires, and are wound around the winding core portion 11 in such a way as to form a double-layered structure. The wires W1 and W4 are wound in a bifilar manner (i.e. the two wires are alternately arranged and wound in a single-layer manner) to make a first winding layer. The wires W2 and W3 are wound in a bifilar manner in such a way as to be placed over the first winding layer, thereby making a second winding layer. The wires W1 to W4 are substantially equal in the number of turns.

The directions in which the wires W1 to W4 are wound are different between the first and second winding layers. For example, when a winding direction from the flange 12A to the flange 12B is seen from the flange 12A, the winding direction of the wires W1 and W4 is anticlockwise, while the winding direction of the wires W2 and W3 is clockwise. In this manner, the winding directions are opposite. The reason behind this is to eliminate the need to extend each wire from one end to the other end of the winding core portion 11 when the winding starts and when the winding ends.

As shown in FIG. 3A, one end W1*a* of the wire W1 is connected to the terminal electrode 15A, and the other end W1*b* is connected to the terminal electrode 15D; one end W4*a* of the wire W4 is connected to the terminal electrode 15C, and the other end W4*b* is connected to the terminal electrode 15F. As shown in FIG. 3B, one end W2*a* of the wire W2 is connected to the terminal electrode 15D, and the other end W2*b* is connected to the terminal electrode 15B; one end W3*a* of the wire W3 is connected to the terminal electrode 15E, and the other end W3*b* is connected to the terminal electrode 15C.

Figure 4:
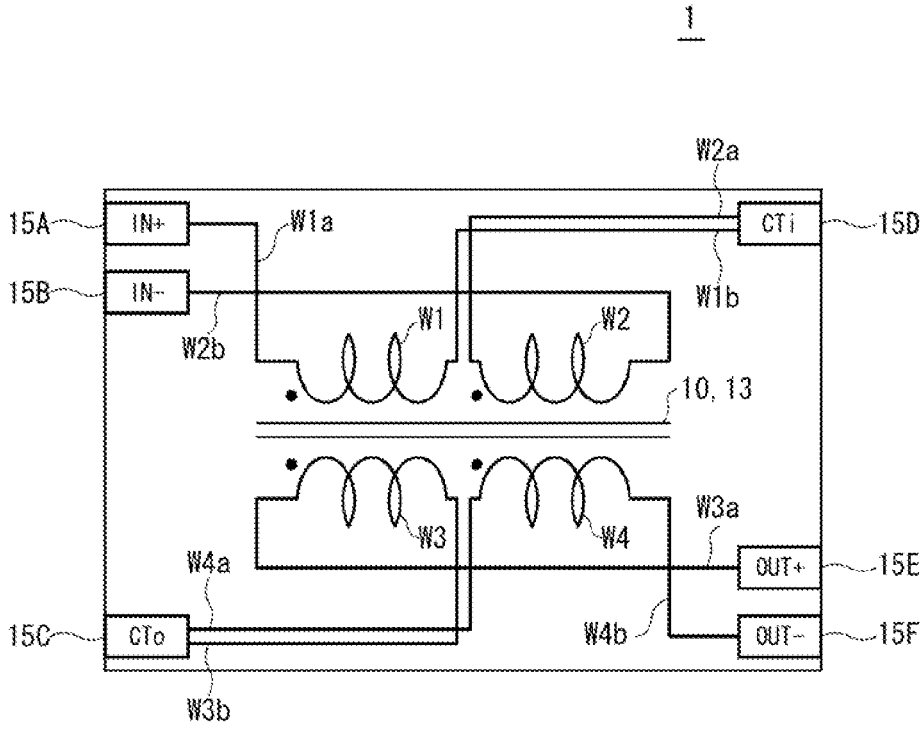
FIG. 4 is a diagram showing an equivalent circuit of the coil component 1.

FIG. 4 is a diagram showing an equivalent circuit of the coil component 1.

As shown in FIG. 4, the terminal electrodes 15A and 15B make up a balanced-input positive terminal IN+ and a balanced-input negative terminal IN−, respectively. The terminal electrodes 15E and 15F make up a balanced-output positive terminal OUT+ and a balanced-output negative terminal OUT−, respectively. The terminal electrode 15C is an output-side center tap CTo. The terminal electrode 15D is an input-side center tap CTi. The wires W1 and W2 are connected in series via the terminal electrode 15D, thereby forming a primary winding of the coil component 1. The wires W3 and W4 are connected in series via the terminal electrode 15C, thereby forming a secondary winding of the coil component 1. The drum core 10 and the plate-like core 13 constitute a closed magnetic circuit of the coil component 1.

The operation of the coil component 1 will be described with reference to FIG. 3B. As shown in FIG. 3B and FIG. 4, as balanced-input current flows through the terminal electrodes 15A and 15B, a magnetic field H is generated in the winding core portion 11 around which the wires W1 and W2 are wound, in such a way as to have an N-pole at the flange 12A side and an S-pole at the flange 12B side. The magnetic field H causes an induced current in the wires W3 and W4, and the induced current works as a balanced-output current. In this manner, the equivalent circuit shown in FIG. 4 is realized.

As described above, the winding direction of the wires W1 and W4 is opposite to the winding direction of the wires W2 and W3. In order for the coil component 1 to operate in the same way as described above (or in order to generate balanced-output current through the magnetic field H) at a time when the winding direction of the wires W1 and W4 is the same as the winding direction of the wires W2 and W3, the wires W2 and W3 need to be connected to the terminal electrodes 15B and 15C and then extended to the flange 12B side before the start of the winding, and need to be extended from the flange 12A side to the terminal electrodes 15D and 15E at the end of the winding to be connected thereto. However, in the case of the coil component 1, such an extension of the wires is unnecessary. The winding of each wire can start from a nearest position of a flange to which the wire is to be connected, and can end at the nearest position.

Figure 5A:
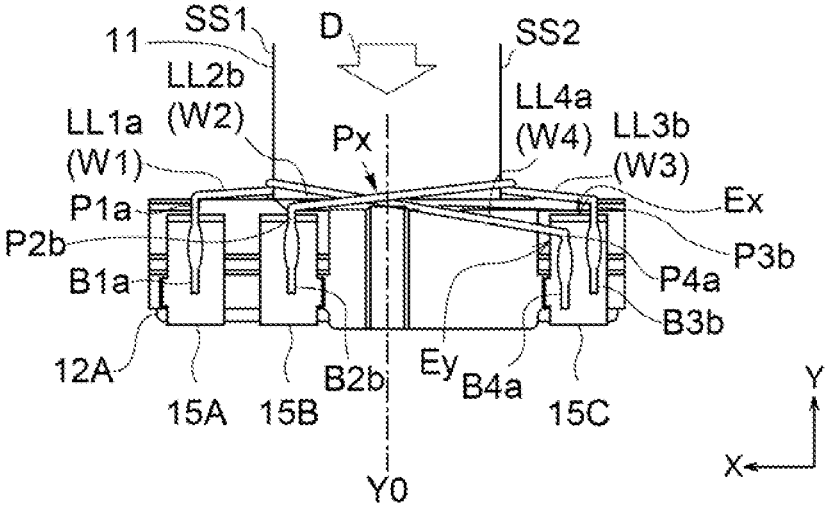
FIG. 5A is a diagram showing a wire-connection structure of terminal portions of the wires W1 to W4 at a flange 12A side, and a schematic plan view when seen from the bottom side.
Figure 5B:
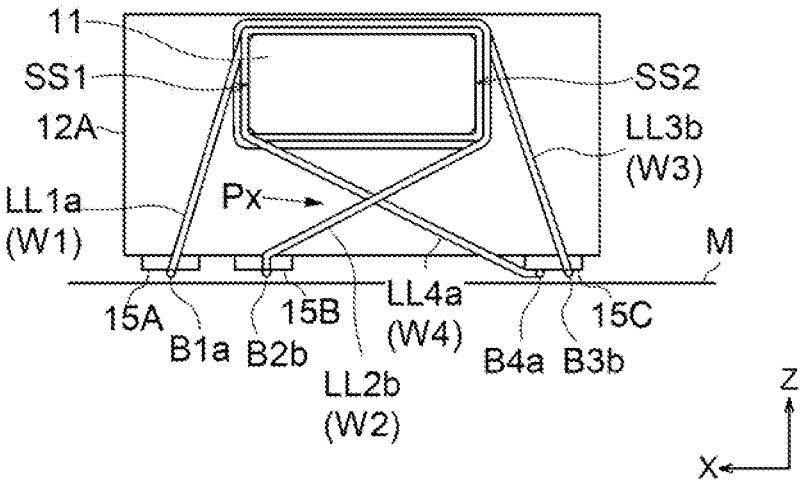
FIG. 5B is a diagram showing the wire-connection structure of terminal portions of the wires W1 to W4 at the flange 12A side, and a schematic plan view when seen from an inner side surface side indicated by arrow D in FIG. 5A.

FIGS. 5A and 5B are diagrams showing a wire-connection structure of terminal portions of the wires W1 to W4 at the flange 12A side. FIG. 5A is a schematic plan view when seen front the bottom side. FIG. 5B is a schematic plan view when seen from an inner side surface side as indicated by arrow D in FIG. 5A.

As shown in FIGS. 5A and 5B, the terminal portions of the first and second wires W1 and W2 are connected to the terminal electrodes 15A and 15B, respectively. The terminal portions of the third and fourth wires W3 and W4 are connected to the common terminal electrode 15C. The first to fourth wires W1 to W4 are connected by thermo-compression bonding to the surfaces of the terminal electrodes.

The wire W1 includes & lead section LL1*a*, which extends from the winding core portion 11 toward the terminal electrode 15A. The lead section LL1*a* is extended downward from an upper end of a side surface SS1 of the winding core portion 11 that is closer to the terminal electrode 15A, so as not to cross the winding core portion 11; the lead section LL1*a* then reaches the terminal electrode 15A. The tip of the lead section LL1*a* constitutes a connecting section B1*a*, which is bonded in a thermo-compression manner to the surface of the terminal electrode 15A. Incidentally, the up-down direction of the coil component 1 is defined based on a normal mounting state of the coil component 1 with respect to a mounting surface M.

The wire W2 includes a lead section LL2*b*, which extends from the winding core portion 11 toward the second terminal electrode 15B. The lead section LL2*b* is extended in a diagonally downward direction from a lower end of a side surface SS2 of the winding core portion 11 that is farther from the second terminal electrode 15B, so as to cross the winding core portion 11; the lead section LL2*b* then reaches the second terminal electrode 15B. The tip of the lead section LL2*b* constitutes a connecting section B2*b*, which is bonded in a thermo-compression manner to the surface of the terminal electrode 15B.

The wire W3 includes a lead section LL3*b*, which extends from the winding core portion 11 toward the third terminal electrode 15C. The lead section LL3*b* is extended downward from an upper end of the side surface SS2 of the winding core portion 11 that is closer to the third terminal electrode 15C, so as not to cross the winding core portion 11; the lead section LL3*b* then reaches the third terminal electrode 15C. The tip of the lead section LL3*b* constitutes a connecting section B3*b*, which is bonded in a thermo-compression manner to the surface of the terminal electrode 15C.

The wire W4 includes a lead section LL4*a*, which extends from the winding core portion 11 toward the third terminal electrode 15C. The lead section LL4*a* is extended in a diagonally downward direction from a lower end of the side surface SS1 of the winding core portion 11 that is farther from the third terminal electrode 15C, so as to cross the winding core portion 11; the lead section LL4*a* then reaches the third terminal electrode 15C. The tip of the lead section LL4*a* constitutes a connecting section B4*a*, which is bonded in a thermo-compression manner to the surface of the terminal electrode 15C. The X-direction position of the connecting section B4*a* is closer to the second terminal electrode 15B than that of the connecting section B3*b* (or the connecting section B4*a* is closer to a width-direction inner side of the flange 12A).

The winding direction of the wire W4 is opposite to that of the wire W2. After being pulled out from the winding core portion 11 at the flange 12A side, the terminal portion of the wire W2 extends to the terminal electrode 15B so as to cross the winding core portion 11. After being pulled out from the winding core portion 11, the terminal portion of the wire W4 extends to the terminal electrode 15C so as to cross the winding core portion 11. Therefore, the lead section LL2*b* of the wire W2 crosses the lead section LL4*a* so as to pass under the lead section LL4*a* of the wire W4.

When viewed from the winding core portion 11 side indicated by arrow D in FIG. 5A, the base position P4*a* of the connecting section B4*a* of the wire W4 is located closer to the far side (or closer to the outer side surface of the flange 12A) of the extending direction (or direction of the central axis $Y_0$) of the winding core portion 11 than the base position P2*b* of the connecting section B2*b* of the wire W2. Incidentally, the base positions P1*a* and P3*b* of the other connecting sections B1*a* and B3*b* are the same as the base position P2*b* of the connecting section B2*b*.

The bottom surface section $T_B$ (See FIG. 2) of each of the terminal electrodes 15A to 15D is substantially rectangular in planar shape, and includes an edge Ex, which extends in the X-direction, and an edge Ey, which extends in the Y-direction. The wires W1, W2, and W3 are pulled out of the corresponding terminal electrodes so as to cross the edges Ex, or the sides closer to the winding core portion 11. The wire W4 is pulled out of the terminal electrode 15C so as not to cross the edge Ex but to cross the edge Ey extending in the Y-direction. Accordingly, a cross point Px of the wires W4 and W2 is located closer to the terminal portion (connecting section B2*b*) of the wire 2 compared with the case where the wire W4 is pulled out so as to cross the edge Ex.

As a result, the lead section LL2*b* of the wire W2 passes under the lead section LL4*a* of the wire W4 and extends to the terminal electrode 15B, and the height-direction (Z-direction) distance between the wires W2 and W4 becomes larger. Therefore, it is possible to prevent contact of the wire W2 with the wire W4; or even if the wire W2 touches the wire W4, the contact pressure can be weakened. As a result, it is possible to prevent an extra load being applied to the base position of the connecting section of the wire W4 by being pushed by the wire W2.

Figure 6A:
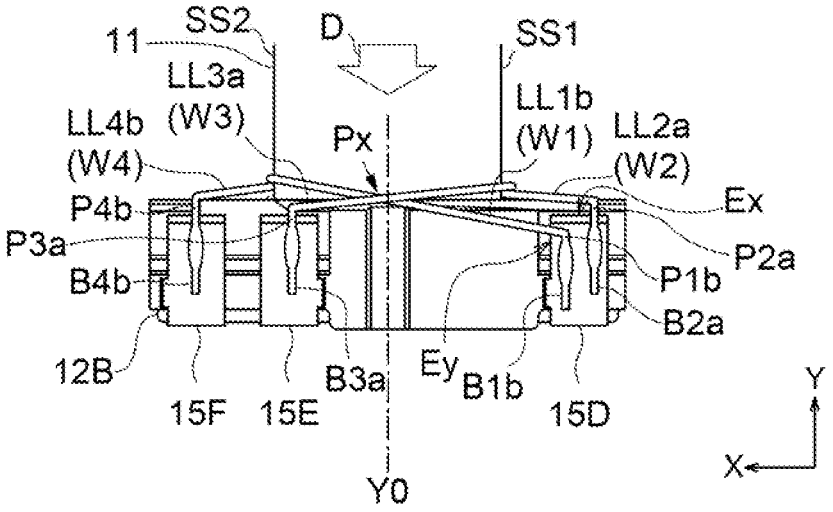
FIG. 6A is a diagram showing a wire connection structure of terminal portions of the wires W1 to W4 at a flange 12B side, and a schematic plan view when seen from the bottom side.
Figure 6B:
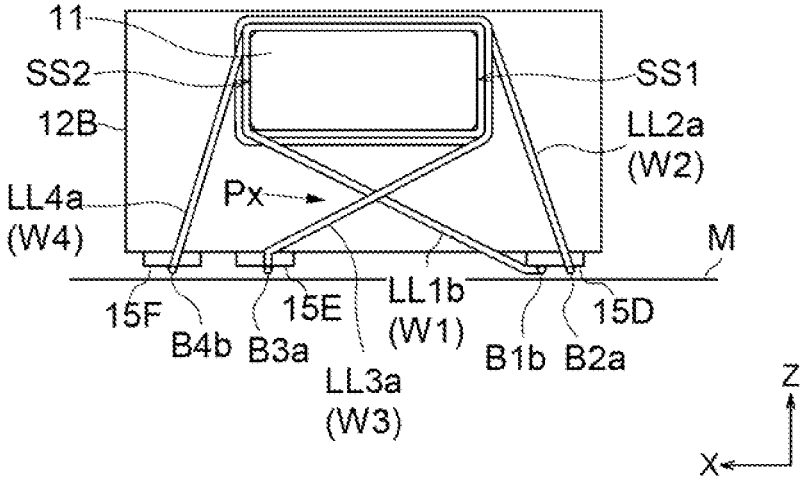
FIG. 6B is a diagram showing a wire connection structure of terminal portions of the wires W1 to W4 at the flange 12B side, arid a schematic plan view when seen from an inner side surface side indicated by arrow D in FIG. 6A.

FIGS. 6A and 6B are diagrams showing a wire connection structure of terminal portions of the wires W1 to W4 at the flange 12B side. FIG. 6A is a schematic plan view when seen from the bottom side. FIG. 6B is a schematic plan view when seen from an inner side surface side as indicated by arrow D in FIG. 6A.

As shown in FIGS. 6A and 6B, since the coil component 1 has a dyad symmetric structure, the wire connection structure at the other-side flange 12B is substantially identical to the wire connection structure at the flange 12A side. The terminal electrodes 15F, 15E, and 15D correspond to the terminal electrodes 15A, 15B, and 15C, respectively. The lead sections LL4*b*, LL3*a*, LL2*a*, and LL1*b* at the flange 12B side correspond to the lead sections LL1*a*, LL2*b*, LL3b, and LL4*a* at the flange 12A side, respectively. The connecting sections B4*b*, B3*a*, B2*a*, and B1*b* at the flange 12B side correspond to the connecting sections B1*a*, B2*b*, B3*b*, and B4*a* at the flange 12A side, respectively.

The lead section LL3*a* of the wire W3 passes under the lead section LL1*b* of the wire 1 and extends to the terminal electrode 15E. The height-direction (X-direction) distance between the wires W3 and W1 becomes larger. Therefore, it is possible to prevent contact of the wire W3 with the wire W1; or even if the wire W3 touches the wire W1, the contact pressure can be weakened. As a result, it is possible to prevent an extra load being applied to the wire W1 by being pushed by the wire W3.

As described above, the coil component of the present embodiment includes two wires that are connected by thermo-compression bonding, with the terminal portions of the wires being laid out so as to cross each other. The base position of a thermo-compression-bonded connecting section of a lower wire that is wound around the winding core portion later is located closer to the outer side surface of a flange than the base position of a thermo-compression-bonded connecting section of an upper wire that is wound around the winding core portion before the lower wire. Therefore, the contact pressure that the upper wire receives from the lower wire at a cross point of the two wires can be curbed. Accordingly, it is possible to prevent an extra load being applied to the base position of the connecting section by that the upper wire is pushed upward by the lower wire. As a result, it is possible to provide a highly reliable coil component.

Figure 7:
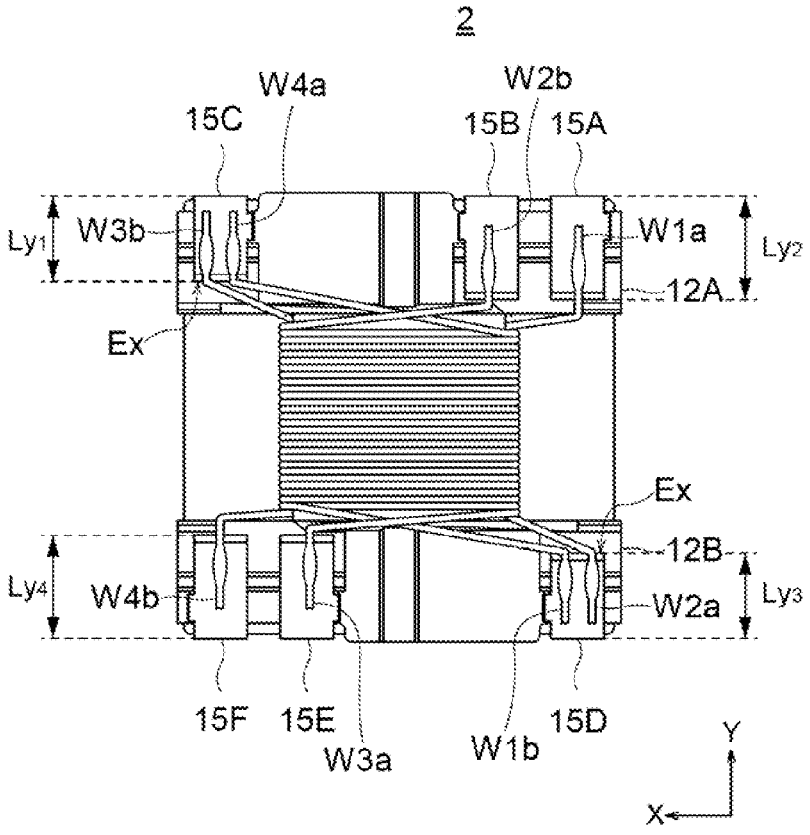
FIG. 7 is a schematic plan view showing the configuration of a coil component according to a second embodiment of the present invention, and shows the configuration of a bottom side thereof.

FIG. 7 is a schematic plan view showing the configuration of a coil component according to a second embodiment of the present invention. The diagram shows the configuration of a bottom side thereof.

As shown in FIG. 7, a coil component 2 is characterized in that: a length $Ly_1$ of a terminal electrode 15C in a Y-direction (or extending direction of a winding core portion 11) is less than a length $Ly_2$ of other terminal electrodes 15A and 15B at a flange 12A side; and that a length $Ly_3$ of a terminal electrode 15D in the Y-direction is less than a length $Ly_4$ of other terminal electrodes 15E and 15F at a flange 12B side. When seen from the winding core portion 11, an edge Ex of the terminal electrode 15C is located closer to the far side than edges Ex of the other terminal electrodes 15A and 15B. When seen from the winding core portion 11, an edge Ex of the terminal electrode 15D is located closer to the far side than edges Ex of the other terminal electrodes 15E and 15F. At the flange 12A side, a terminal section W4*a* of a wire W4 is pulled out so as to cross the edge Ex of the terminal electrode 15C in the same way as terminal sections of the other wires W1, W2, and W3. At the flange 12B side, a terminal section W1*b* of the wire W1 is pulled out so as to cross the edge Ex of the terminal electrode 15D in the same way as the other wires W2, W3, and W4. The rest of the configuration is the same as that of the coil component 1 of the first embodiment.

According to the present embodiment, in addition to the advantageous effects of the invention achieved by the first embodiment, it is easy to connect the wires W3 and W4 on the terminal electrode 15C and the wires W1 and W2 on the terminal electrode 15D.

Figure 8:
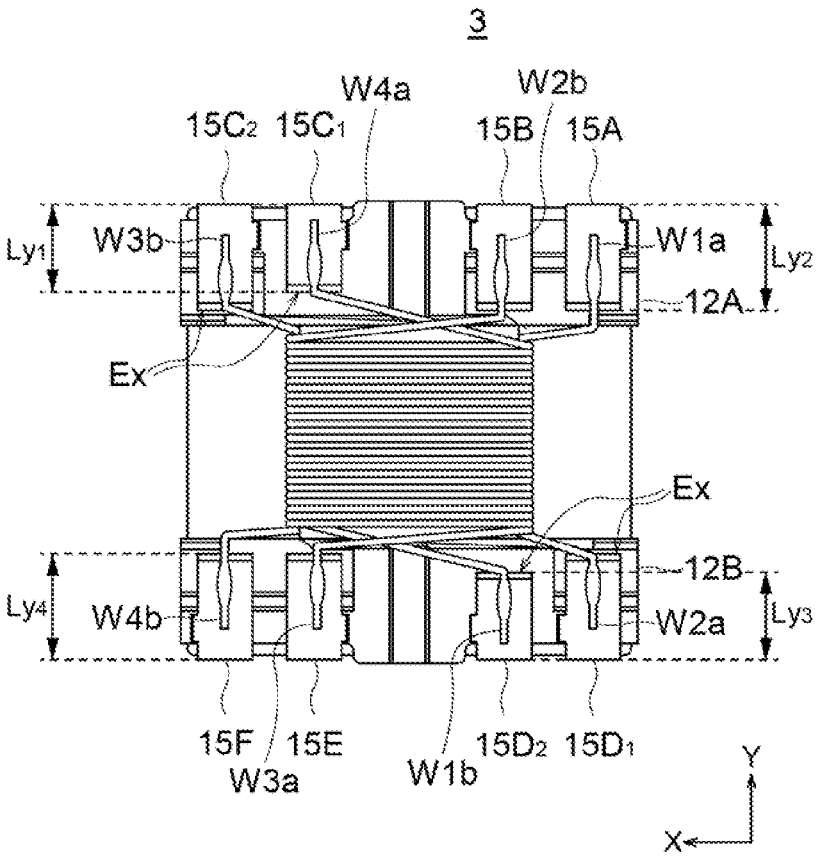
FIG. 8 is a schematic plan view showing the configuration of a coil component according to a third embodiment of the present invention, and shows the configuration of a bottom side thereof.

FIG. 8 is a schematic plan view showing the configuration of a coil component according to a third embodiment of the present invention. The diagram shows the configuration of a bottom side thereof.

As shown in FIG. 8, a coil component 3 is characterized in that the number of terminal electrodes provided in each of flanges 12A and 12B is not 3 but 4. In the flange 12A, four terminal electrodes 15A, 15B, $15C_1$, and $15C_2$ are provided. In the flange 12B, four terminal electrodes $15D_1$, $15D_2$, 15E, and 15F are provided. A terminal section W1*b* of a wire W1 and a terminal section W2*a* of a wire W2, and a terminal section W3*b* of a wire W3 and a terminal section W4*a* of a wire W4 are electrically connected via a wiring pattern (land) on a substrate when the coil component 3 is mounted.

Even in the case of the present embodiment, an edge Ex of the terminal electrode $15C_1$ at the flange 12A side to which the terminal section W4*a* of the wire W4 is connected is preferably located closer to the far side (or outer side surface of the flange 12A) than edges Ex of the other terminal electrodes 15A, 15B, and $15C_2$. Similarly, an edge Ex of the terminal electrode $15D_2$ at the flange 12B side to which the terminal section W1*b* of the wire W1 is connected is preferably located closer to the far side (or outer side surface of the flange 12B) than edges Ex of the other terminal electrodes $15D_1$, 15E, and 15F. According to this configuration, it is easy to connect the wire W4 on the terminal electrode $15C_1$ and the wire W1 on the terminal electrode $15D_2$.

As described above, in the coil component 3 of the present embodiment, on the mounting substrate, the two terminal electrodes $15C_1$ and $15C_2$ are short-circuited, and the two terminal electrodes $15D_1$ and $15D_2$ are short-circuited. Therefore, the same configuration as that of the coil component 1 of the first embodiment can be realized. Accordingly, it is possible to achieve the same operation and advantageous effects as the first embodiment.

It is apparent that the present invention is not limited to the above embodiments, but may be modified and changed without departing from the scope and spirit of the invention.

For example, in the above-described embodiments, as a coil component, the pulse transformer has been described as an example. However, the present invention is not limited to the pulse transformer. The present invention may be applied to various coil components. Moreover, the number of terminals on one side is not limited to 3 or 4. There may be any number of terminals.

In the above-described embodiments, as a terminal electrode, a metal terminal that is bonded to a flange has been used. However, the configuration of the terminal electrodes is not specifically limited in the present invention. Electrodes formed by plating, printing, vapor deposition, and the like may be available.

In the above-described third embodiment, when seen from the winding core portion 11, the near-end-side edge Ex of the terminal electrode $15C_1$ is disposed closer to the far side in the extending direction of the winding core portion 11 than the near-end-side edges Ex of the other terminal electrodes 15A, 15B, and $15C_2$. However, this structure is not necessarily required. The edge Ex of the terminal electrode $15C_1$ may be aligned with the near-end-side edges Ex of the other terminal electrodes 15A, 15B, and $15C_2$, as in the case of the first embodiment.

What is claimed is:

1. A coil component comprising:

a core including a winding core portion;

first and second wires wound around the winding core portion; and first and second terminal electrodes provided on a surface of the core, wherein the first wire includes a first lead section extending in a diagonally downward direction from the winding core portion toward the first terminal electrode so as to cross the winding core portion, and a first connecting section connected to the first terminal electrode, the second wire includes a second lead section extending in a diagonally downward direction from the winding core portion toward the second terminal electrode so as to cross the winding core portion, and a second connecting section connected to the second terminal electrode, the first lead section crosses the second lead section so as to pass under the second lead section, and a base position of the second connecting section when viewed from the winding core portion side is located closer to a far side in an extending direction of the winding core portion than a base position of the first connecting section.

2. The coil component as claimed in claim 1, wherein a length of the second terminal electrode in the extending direction of the winding core portion is less than a length of the first terminal electrode in the extending direction of the winding core portion, and a near-end-side edge of the second terminal electrode when viewed from the winding core portion side is located closer to a far side in the extending direction of the winding core portion than a near-end-side edge of the first terminal electrode.

3. The coil component as claimed in claim 1, wherein the first terminal electrode and the second terminal electrode are line-symmetric, when viewed from a central axis of the winding core portion.

4. The coil component as claimed in claim 1, wherein the core includes a flange provided in one end of the winding core portion, and the first and second terminal electrodes are provided on a surface of the flange.

5. The coil component as claimed in claim 1, wherein the first and second connecting sections are connected by thermo-compression bonding.

6. A coil component comprising:

a drum core including a winding core portion and first and second flanges provided at both ends of the winding core portion;

first to fourth wires wound around the winding core portion;

first to third terminal electrodes provided on a surface of the first flange; and fourth to sixth terminal electrodes provided on a surface of the second flange, wherein the first wire includes a first lead section extending downward from the winding core portion toward the first terminal electrode so as not to cross the winding core portion, a first connecting section connected to the first terminal electrode, a second lead section extending in a diagonally downward direction from the winding core portion toward the fourth terminal electrode so as to cross the winding core portion, and a second connecting section connected to the fourth terminal electrode, the second wire includes a third lead section extending downward from the winding core portion toward the fourth terminal electrode so as not to cross the winding core portion, a third connecting section connected to the fourth terminal electrode, a fourth lead section extending in a diagonally downward direction from the winding core portion toward the second terminal electrode so as to cross the winding core portion, and a fourth connecting section connected to the second terminal electrode, the third wire includes a fifth lead section extending in a diagonally downward direction from the winding core portion toward the fifth terminal electrode so as to cross the winding core portion, a fifth connecting section connected to the fifth terminal electrode, a sixth lead section extending downward from the winding core portion toward the third terminal electrode so as not to cross the winding core portion, and a sixth connecting section connected to the third terminal electrode, the fourth wire includes a seventh lead section extending in a diagonally downward direction from the winding core portion toward the third terminal electrode so as to cross the winding core portion, a seventh connecting section connected to the third terminal electrode, an eighth lead section extending downward from the winding core portion toward the sixth terminal electrode so as not to cross the winding core portion, and an eighth connecting section connected to the sixth terminal electrode, the fourth lead section passes under the seventh lead section to cross the seventh lead section, the fifth lead section passes under the second lead section to cross the second lead section, a base position of the seventh connecting section when viewed from the winding core portion side is located closer to an outer side surface of the first flange than a base position of the fourth connecting section, and a base position of the second connecting section when viewed from the winding core portion side is located closer to an outer side surface of the second flange than a base position of the fifth connecting section.

7. The coil component as claimed in claim 6, wherein a length of the third terminal electrode in an extending direction of the winding core portion is less than a length of the first terminal electrode in the extending direction of the winding core portion, a length of the fourth terminal electrode in the extending direction of the winding core portion is less than a length of the sixth terminal electrode in the extending direction of the winding core portion, a near-end-side edge of the third terminal electrode when viewed from the winding core portion side is located closer to the outer side surface of the first flange than a near-end-side edge of the first terminal electrode, and a near-end-side edge of the fourth terminal electrode when viewed from the winding core portion side is located closer to the outer side surface of the second flange than a near-end-side edge of the sixth terminal electrode.

8. The coil component as claimed in claim 6, wherein the first terminal electrode and the third terminal electrode are line-symmetric, when viewed from a central axis of the winding core portion, and the fourth terminal electrode and the sixth terminal electrodes are line-symmetric, when viewed from the central axis of the winding core portion.

9. The coil component as claimed in claim 6, wherein a width of a space between the second and third terminal electrodes is greater than a width of a space between the first and second terminal electrodes, and a width of a space between the fourth and fifth terminal electrodes is greater than a width of a space between the fifth and sixth terminal electrodes.

10. The coil component as claimed in claim 6, wherein the first to eighth connecting sections are connected by thermo-compression bonding.

11. A coil component comprising:

a drum core including a winding core portion and first and second flanges provided at both ends of the winding core portion;

first to fourth wires wound around the winding core portion;

first to fourth terminal electrodes provided on a surface of the first flange; and fifth to eighth terminal electrodes provided on a surface of the second flange, wherein the first wire includes a first lead section extending downward from the winding core portion toward the first terminal electrode so as not to cross the winding core portion, a first connecting section connected to the first terminal electrode, a second lead section extending in a diagonally downward direction from the winding core portion toward the sixth terminal electrode so as to cross the winding core portion, and a second connecting section connected to the sixth terminal electrode, the second wire includes a third lead section extending downward from the winding core portion toward the fifth terminal electrode so as not to cross the winding core portion, a third connecting section connected to the fifth terminal electrode, a fourth lead section extending in a diagonally downward direction from the winding core portion toward the second terminal electrode so as to cross the winding core portion, and a fourth connecting section connected to the second terminal electrode, the third wire includes a fifth lead section extending in a diagonally downward direction from the winding core portion toward the seventh terminal electrode so as to cross the winding core portion, a fifth connecting section connected to the seventh terminal electrode, a sixth lead section extending downward from the winding core portion toward the fourth terminal electrode so as not to cross the winding core portion, and a sixth connecting section connected to the fourth terminal electrode, the fourth wire includes a seventh lead section extending in a diagonally downward direction from the winding core portion toward the third terminal electrode so as to cross the winding core portion, a seventh connecting section connected to the third terminal electrode, an eighth lead section extending downward from the winding core portion toward the eighth terminal electrode so as not to cross the winding core portion, and an eighth connecting section that is connected to the eighth terminal electrode, the fourth lead section passes under the seventh lead section to cross the seventh lead section, the fifth lead section passes under the second lead section to cross the second lead section, a base position of the seventh connecting section when viewed from the winding core portion side is located closer to an outer side surface of the first flange then a base position of the fourth connecting section, and a base position of the second connecting section when viewed from the winding core portion side is located closer to an outer side surface of the second flange than a base position of the fifth connecting section.

12. The coil component as claimed in claim 11, wherein a length of the third terminal electrode in an extending direction of the winding core portion is less than a length of the first terminal electrode in the extending direction of the winding core portion, a length of the sixth terminal electrode in the extending direction of the winding core portion is less than a length of the eighth terminal electrode in the extending direction of the winding core portion, a near-end-side edge of the third terminal electrode when viewed from the winding core portion side is located closer to an outer side surface of the first flange than a near-end-side edge of the first terminal electrode, and a near-end-side edge of the sixth terminal electrode when viewed from the winding core portion side is located closer to an outer side surface of the second flange than a near-end-side edge of the eighth terminal electrode.

13. The coil component as claimed in claim 11, wherein the first terminal electrodes and the fourth terminal electrodes are line-symmetric, when viewed from a central axis of the winding core portion, the second terminal electrodes and the third terminal electrodes are line-symmetric, when viewed from the central axis of the winding core portion, the fifth terminal electrodes and the eighth terminal electrodes are line-symmetric, when viewed from the central axis of the winding core portion, and the sixth terminal electrodes and the seventh terminal electrodes are line-symmetric, when viewed from the central axis of the winding core portion.

14. The coil component as claimed in claim 11, wherein a width of a space between the second and third terminal electrodes is greater than a width of a space between the first and second terminal electrodes, and a width of a space between the sixth and seventh terminal electrodes is greater than a width of a space between the seventh and eighth terminal electrodes.

15. The coil component as claimed in claim 11, wherein the first to eighth connecting sections are connected by thermo-compression bonding.

16. A coil component comprising:

a core including a flange having inner and outer surfaces opposite to each other and a bottom surface, and a winding core portion connected to the inner surface of the flange;

a first terminal electrode provided on the bottom surface of the flange;

a second terminal electrode provided on the bottom surface of the flange;

a first wire including a first wound section wound around the winding core portion in a clockwise direction, a first bonded section bonded to the first terminal electrode, and a first lead section located between the first wound section and the first bonded section; and a second wire including a second wound section wound around the winding core portion in a counterclockwise direction, a second bonded section bonded to the second terminal electrode, and a second lead section located between the second wound section and the second bonded section, wherein the first lead section and the second lead section intersect with each other so that a part of the second lead section is positioned between the first lead section and the inner surface of the flange, and the second lead section is closer to the outer surface of the flange than the first lead section.

17. The coil component as claimed in claim 16, wherein each of the first and second terminal electrodes has an inner edge substantially parallel to and closer to the inner surface of the flange, and a first distance between the inner edge of the first terminal electrode and the inner surface of the flange is substantially the same as a second distance between the inner edge of the second terminal electrode and the inner surface of the flange.

18. The coil component as claimed in claim 17, wherein the second terminal electrode further has a side edge substantially parallel to a central axis of the winding core portion, and the second lead section intersects with the side edge of the second terminal electrode without intersecting with the inner edge of the second terminal electrode.

19. The coil component as claimed in claim 18, wherein the first terminal electrode further has a side edge substantially parallel to the central axis of the winding core portion, and the first lead section intersects with the inner edge of the first terminal electrode without intersecting with the side edge of the first terminal electrode.

20. The coil component as claimed in claim 16, wherein each of the first and second terminal electrodes has an inner edge substantially parallel to and closer to the inner surface of the flange, and a first distance between the inner edge of the first terminal electrode and the inner surface of the flange is greater than a second distance between the inner edge of the second terminal electrode and the inner surface of the flange.

* * * * *